US006202529B1

(12) United States Patent
Hodsdon

(10) Patent No.: US 6,202,529 B1
(45) Date of Patent: Mar. 20, 2001

(54) SLICING AID FOR ROUNDLY SHAPED BREAD PRODUCTS

(76) Inventor: Jerry Grant Hodsdon, P.O. Box 141, Forestdale, MA (US) 02644

( * ) Notice: Subject to any disclaimer, the term of this patent is extended or adjusted under 35 U.S.C. 154(b) by 0 days.

(21) Appl. No.: 09/329,103

(22) Filed: Jun. 9, 1999

(51) Int. Cl.[7] ..... B26D 3/00

(52) U.S. Cl. ..... 83/870; 83/761; 83/454; 83/932

(58) Field of Search ..... 83/761, 762, 454, 83/821, 932, 290, 870, 745, 436.2; 269/87.2, 295

(56) References Cited

U.S. PATENT DOCUMENTS 4,948,106 * 8/1990 Popeil et al. ..... 83/762
5,431,078 * 7/1995 Ricard et al. ..... 83/870
5,481,953 * 1/1996 McLeod ..... 83/762
5,638,734 * 6/1997 Fish ..... 83/762
5,690,013 * 11/1997 Kanarek et al. ..... 83/762
5,718,158 * 2/1998 Rogge ..... 83/762
5,724,877 * 3/1998 Kensrue ..... 83/870
5,819,629 * 10/1998 Sarich ..... 83/745
5,921,163 * 7/1999 McInnes et al. ..... 83/870
5,946,998 * 9/1999 Thompson ..... 83/870

* cited by examiner

*Primary Examiner*—Rinaldi I. Rada
*Assistant Examiner*—Omar Flores-Sánchez

(57) ABSTRACT

This invention is a safe, effective, attractive apparatus for slicing bread products such as bagels, bulkie rolls, and English muffins into two approximately equal sections. The invention is comprised of two primary components. The base unit (1) is essentially a rectangular block with a narrow slot (5) on either side of a cavity (3) that is open at the top and shaped to receive and center a bread product (12). The second component is a unique separate top block (2) that has an inverted slot (6) on the underside to receive a knife so that it is recessed from the underside of the top block. A knife is placed into the slot of the top block, and together they are placed into the chamber of the base unit, with the knife now guided by the slots on either side of the base unit. The top block is used to hold down the bread product to keep it from rotating, while keeping fingers safely away from the knife blade. The user draws the knife back and forth, and is able to cut easily through the bread product.

14 Claims, 4 Drawing Sheets

SLICING AID FOR ROUNDLY SHAPED BREAD PRODUCTS

CROSS REFERENCE TO RELATED APPLICATIONS Not applicable.

1. BACKGROUND - FIELD OF THE INVENTION

This present invention relates generally to methods and apparatus for safely slicing roundly shaped bread products such as bagels, bulkie rolls, and English muffins into two approximately equal sections.

2. BACKGROUND - DISCUSSION OF PRIOR ART

The operation of slicing bagels and other roundly shaped bread products into two approximately equal halves is commonly done without a mechanical aid. It is often done by holding the bread product in one hand and using a cutting utensil in the other hand to cut it into two sections, or holding the bread product down on a table and slicing it horizontally. This often results in unequal sections, and serious injuries can and do result using these methods. It has been reported that a leading cause of emergency room visits is injuries received while slicing bagels in particular. For these reasons a number of apparatus have been invented to try to improve this operation.

There are numerous variations in prior art, however two versions are most commonly utilized, both of which have shortcomings. The most common version is a rectangular box made of either wood or clear plastic, open at the top with opposed slots on either side. The drawbacks of this design are that the bread product is prone to spinning in the holder and still needs to be held with the hand, so injury could result. Also, having a wide opening, vertical sides and a flat bottom, the cut will often be off center, making the sections uneven.

A second style, U.S. Pat. No. 5,431,078 to Ricard and Cann (1994) has a single, "V" shaped blade attached to a handle in a track over a similar rectangular box. The food preparer pushes the blade down through the bread product. The drawbacks of this design are that the bread product can become deformed by this cutting action and a significant amount of force is required to cut a bread product in such a fashion. Also, the blade must be very sharp, so there is a risk of injury and reduced effectiveness if dulling occurs, and the design allows the bread product to be cut off center.

Many other prior art designs involve complex mechanisms that are costly to produce, difficult to clean, or non-intuitive and difficult to understand. Some designs, such as U.S. Pat. No. 4,948,106 to Popeil and Backus (1990), are tall and unstable. Other designs puncture a hole in the bread product and would function poorly with irregularly shaped bread products. Only one known prior art design patent, U.S. Pat. No. D379,907 to Israeli (1997), has a separate top piece to hold the bread product from rotating, however the holding force is perpendicular to the cutting plane, making the cutting operation more difficult. Also, this design causes the cut to be incomplete, stopping short of cutting all the way through the bread product. In addition, the cutting action is horizontal, which is uncomfortable and requires more force to maintain stability, and fingers can easily end up in the path of the cutting utensil while attempting to hold it steady.

SUMMARY

The present invention is a safe, effective, attractive apparatus for slicing roundly shaped bread products such as bagels into two approximately equal halves. The present invention is comprised of two primary components. The base unit is essentially a rectangular block with a chamber that is open at the top, which is uniquely shaped to receive and center the lower portion of a bread product. A narrow slot through the middle of the base unit provides a means for guiding a special or conventional bread knife through the middle of a bread product. The front and back of the base unit has a "U" shaped opening from the top down to the approximate center of a bread product that allows for easy insertion and removal of a bread product. The base unit has a step on the front and back of the unit to make it wider, providing additional stability. The second component of the invention is a separate top block that has an inverted slot on the underside to receive the knife so that it is completely recessed from the underside of the top block. To use the unit, once the bread product is inserted into the chamber in the base unit, the knife is inserted blade down into the slot in the top block, and together they are placed into the chamber of the base unit, on top of the bread product. No known prior art with a downward cutting motion contains this critical separate top piece. A low cutting force is required because the holding force applied to the bread product is in the same direction as the slicing plane, in comparison to many prior art designs which apply the holding force perpendicular to the slicing plane, increasing the force required to draw the cutting utensil through the bread product. Using light pressure to keep the bread product from rotating, the user draws the knife back and forth, and is able to cut easily through the bread product. When the bread product has been cut all the way through, the user removes the top piece and the knife, and takes the bread product out of the base unit, ready for further preparation.

Objects and Advantages

A principal object of the present invention is to provide a safe, effective apparatus for slicing numerous bread products, and bagels in particular, into two approximately equal halves, that overcomes the shortcomings of prior art.

Another object of this invention is to provide a means of keeping a rounded bread product from spinning during the slicing operation in a way that does not increase the cutting force by applying the holding force parallel to the cutting plane.

Another object of this invention is to provide an apparatus for slicing bread products that requires a minimum of counter space and is economical enough for the common household.

Another object of this invention is to provide an apparatus for slicing bread products that is does not damage the bread product during the slicing operation, and is easy to clean.

DETAILED DESCRIPTION OF THE PREFERRED EMBODIMENT

Figure 1:
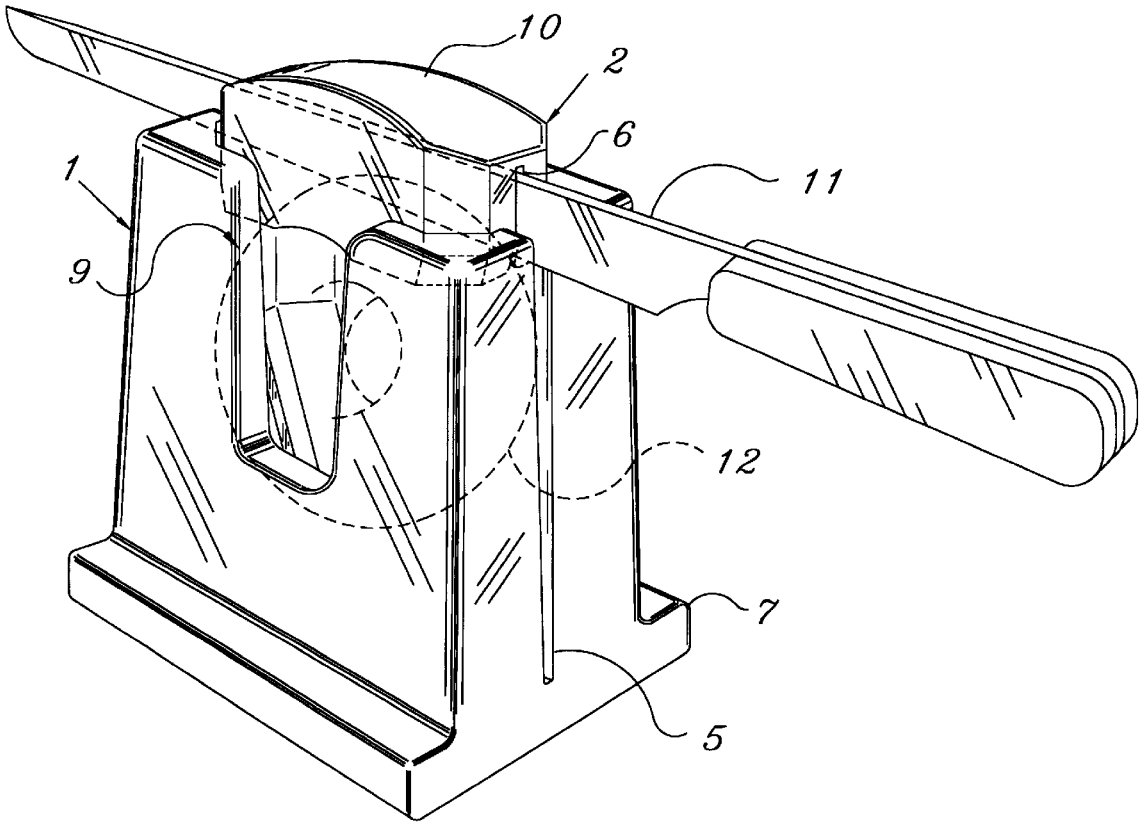
FIG. 1 is a perspective view of the bread product slicing aid constructed in accordance with the present invention showing a bread product positioned therein and a knife engaged in slicing the bread product.
Figure 2:
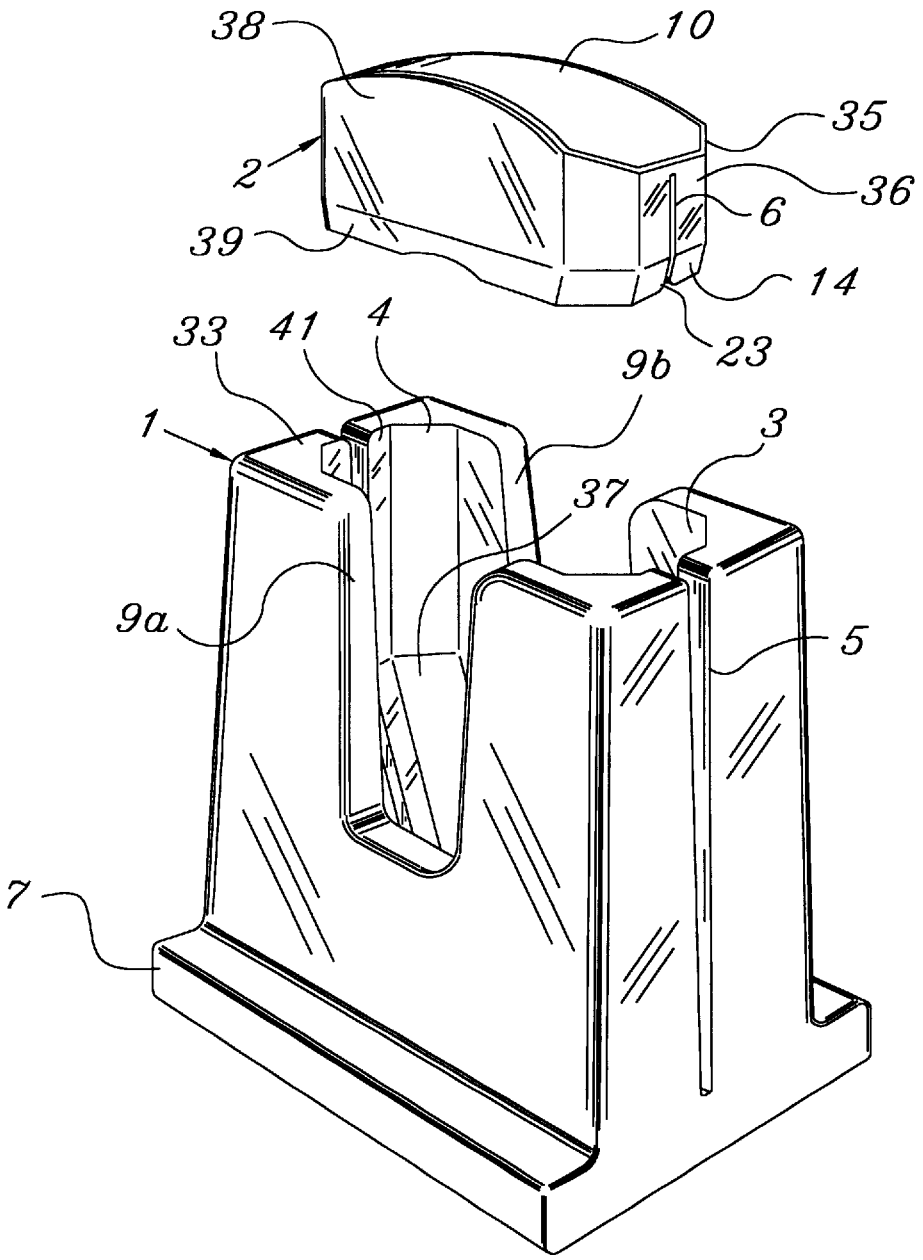
FIG. 2 is a perspective view of the bread product slicing aid constructed in accordance with the present invention.

Referring to FIG. 1 and FIG. 2, the preferred embodiment of the invention would be comprised primarily of injection molded plastic components. The two principal components are a base unit 1 and a top block 2. Base unit 1 has a chamber 3 which is open at the top, and is designed to receive and align a bread product 12, in this case a bagel, for cutting. This chamber 3 has a uniquely designed set of planar surfaces 37 that center the lower portion of bread product 12. Chamber 3 has "U" shaped openings 9*a* and 9*b* at the front and back of base unit 1 for easy insertion and removal of bread product 12. In the middle of base unit 1 there is a slot 5 that acts as a guide for a cutting utensil 11 while cutting through bread product 12. There is a step 7 on the front and back of base unit for additional stability during the slicing operation.

One of the primary components that make this invention unique and superior to prior art is a separate upper assembly, referred to as top block 2. Top block 2 is rounded on the top 10 to provide an ergonomic fit with the natural curvature of the human hand. During the slicing operation, the curvature of the top 10 of top block 2 also makes it easier for the user to distribute a controlled amount of pressure between top 10 of top block 2 and the top surfaces 33 of base unit 1 over a wide range of bread product sizes, so as to constrain but not crush or damage bread product 12. Top block 2 also has a slot 6 on the underside designed to receive a cutting utensil 11 so that it is completely recessed in slot 6 when placed together on the top of bread product 12 in chamber 3 of base unit 1. Slot 6 has a radius 23 at each of the lower corners to facilitate easy insertion of cutting utensil 11 into slot 6 prior to inserting them together into chamber 3. Top block 2 is designed in such a way as to be a loose slip fit into chamber 3 of base unit 1. Top block 2 has vertical chamfers 35 on each of the four corners that correspond with chamfers 4 in base unit 1. At the lower portion of each of the vertical surfaces of top block 2 is a series of angled planar surfaces 14 that are angled inward on the sides 36 and chamfers 35 at the same angles as angled planar surfaces 37, of chamber 3. When top block 2 is placed into chamber 3 without a bread product 12 present, for storage when not in use, the angled planar surfaces 14 of top block 2 rest on corresponding angled planar surfaces 37 in chamber 3 of base unit 1. The front and back vertical surfaces 38 of top block 2 also have slightly angled planar surfaces 39 that do not have corresponding angled planar surfaces in chamber 3 of base unit 1. The angled planar surfaces 14 and 39 on top block 2 also serve to assist in the insertion and alignment of top block 2 when it is being inserted into chamber 3 of base unit 1. The underside of top block 2 is concave and designed to center the top of bread product 12 with respect to slot 6.

Figure 3:
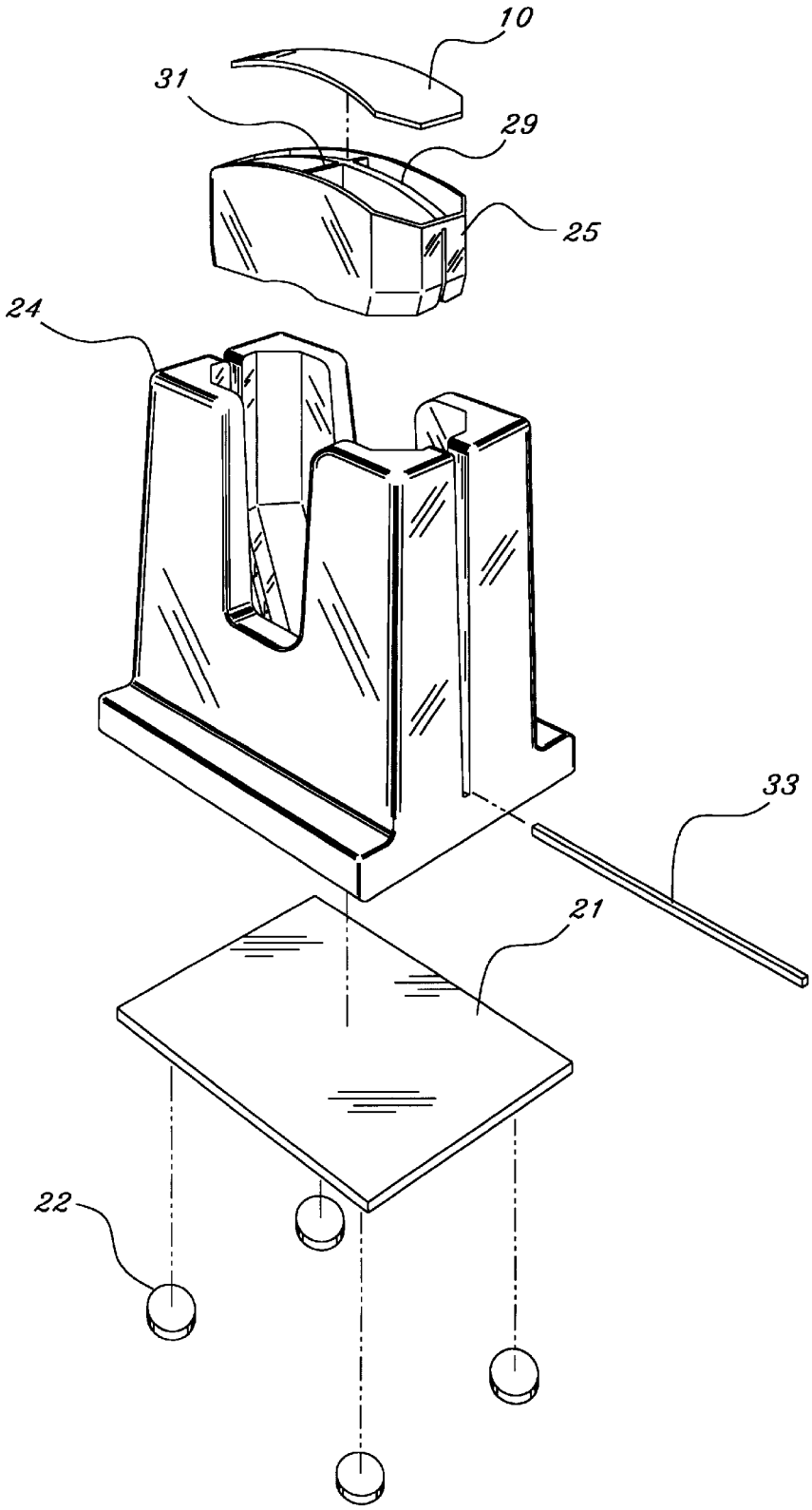
FIG. 3 is an exploded view of the bread slicing aid constructed in accordance with the present invention.

FIG. 3 shows each separate component in an exploded view. Top block 2 is composed of two components; namely a main body 25 of top block 2 and a top cover 10. A curved rib 29 and a cross support 31 that also provides rigidity to main body 25 support top cover 10. Main body 25 and top cover 10 can be permanently bonded using adhesive or a similar bonding process such as sonic welding. Base unit 1 is composed of chamber section 24 and a cut resistant wear strip 33. Four round feet 22 made of rubber or some other non-slip material are bonded to bottom cover 21 with adhesive. Alternate embodiments could replace four round feet 22 with one or two rectangular sections of non-slip material, producing the same end result.

Figure 4:
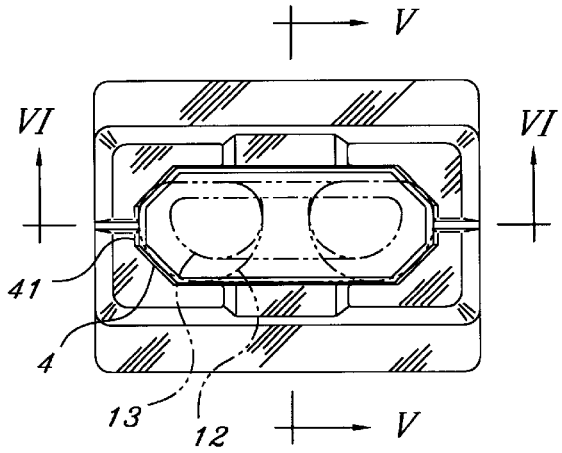
FIG. 4 is a plan view taken from above showing the top block positioned in alignment with the cavity in the base unit showing the largest and smallest bread product positioned therein.
Figure 5:
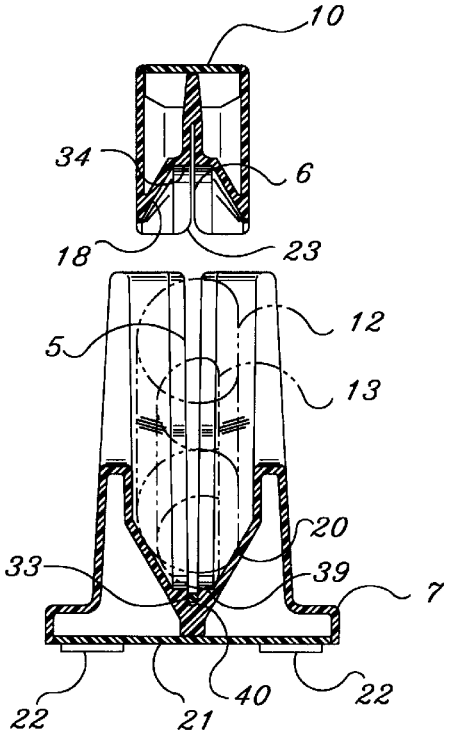
FIG. 5 is a cross-sectional side view taken along line V—V of FIG. 4 unit showing the largest and smallest bread product positioned therein.
Figure 6:
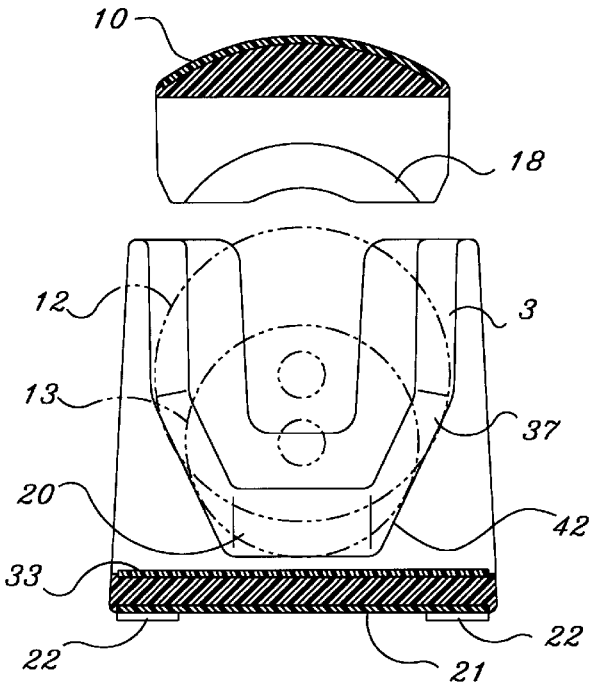
FIG. 6 is a cross-sectional front view taken along line VI—VI of FIG. 4 unit showing the largest and smallest bread product positioned therein.

FIG. 4 is a plan view of the invention viewed from above. From this view it is evident that top piece 2 is designed to be a loose slip fit into chamber 3 of base unit 1. The cross-sectional view V—V is shown in FIG. 5, and the cross-sectional view VI—VI is shown in FIG. 6. The cross-sectional views illustrate, among other things, how this invention is superior to prior art in that the design of chamber 3 and top block 2 are effective in centering a variety of size and shape bread products, from large bread products 12 to small bread products 13. FIG. 5 illustrates how bread product 12 or 13 is centered with respect to slot 5 and inverted slot 6 by the design of top block 2 and chamber 3. Top block 2 has, on the underside, angled surfaces 18 that are conical around the central axis of bread product 12 or 13, which center the top of bread product 12 or 13 with respect to slot 6. There are also short horizontal surfaces 34 for centering and applying pressure to narrow bread products, such as English muffins, separated by a slot 6, designed to receive a cutting utensil 11. Slot 6 is just wide enough and deep enough to allow a cutting utensil 11 to be completely recessed when placed into slot 6. Slot 6 has a radius 23 at the bottom corners to facilitate insertion of cutting utensil 11 into slot 6. When top block 2 is placed into chamber 3 of base unit 1, slot 6 in the center of top block 2 is aligned with slot 5 in base unit 1, which guide cutting utensil 11 during the slicing operation. In FIG. 5, we also see that in cross section V—V of base unit 1, chamber 3 has nearly vertical sides from the top until about three-quarters of the way down. At that point two equal planes 20 angle inward for the lower section of chamber 3, supporting and centering a wide range of bread products, from large 12 to small 13. There is a short horizontal section 39 at the bottom of each of angled planes 20 that centers and provides support for narrow bread products, such as English muffins. Horizontal sections 39 are separated by a recess 40 that allows cutting utensil 11 to cut all the way through bread product 12 or 13. In the bottom of recess 40 in the preferred embodiment is a strip of cut resistant plastic 24 such as UHMW, to protect the invention from damage during the slicing operation. When viewed as cross section VI—VI as in FIG. 6, it is evident that chamber 3, rather than being rounded at the bottom, is comprised of a series of angled planes that further serve to center bread product 12 or 13 both front to back and side to side. This is further illustrated in FIG. 2 and FIG. 4, where it is evident that chamber 3 has a two short planar surfaces 41 separated by slot 5 parallel to the central axis of the bread product 12 or 13 and a chamfer 4 at each of the four corners. These short planar surfaces 41 and chamfers 4 follows the line of inner chamber 3 along angled surfaces 42 in FIG. 6 to horizontal surface 39 which is also shown in cross section in FIG. 5.

To utilize the invention, a bread product 12 is placed into chamber 3 of base unit 1. The angled planar surfaces at the bottom of chamber 3 center the lower section of bread product 12 with respect to slot 5 in base unit 1. A cutting utensil 11 is placed into slot 6 of top block 2, and together they are placed into chamber 3 of base unit 1 on top of bread product 12. The angled surfaces on the underside of top block 2 center the bread product 12 with respect to slot 6. The cutting utensil 11 is now guided by slot 5 in the middle of base unit 1. Applying light pressure to the top section 10 of top block 2 keeps bread product 12 from rotating while cutting utensil 11 is drawn back and forth to cut through bread product 12. When cutting is complete, cutting utensil 11 is pulled out of slot 5 and top block 2 is removed from chamber 3 of base unit 1. The bisected bread product 12 is removed by reaching into openings 9*a* and 9*b* on the front and back of base unit 1 and lifting it vertically out of chamber 3. When not in use for slicing bread products, top block 2 can be stored in chamber 3.

Conclusion, Ramifications and Scope

No prior art contains all the features and benefits of the present invention, yet the design is simple to understand, simple to use, and inexpensive to produce. The benefits include:

- Maximum safety, because the position of the hand used to hold the device in place and apply a downward holding force is above the cutting utensil that would be cutting in a downward direction, keeping fingers safely away from the path of the cutting utensil. In addition, the base is widened at the bottom, so it has a high degree of stability.
- Minimal cutting force required, because the holding force is in the same direction as the cutting plane, and the cutting utensil can be drawn back and forth through the bread product, rather than forcing a fixed blade through the bread product, as some prior art designs require. All know prior art devices either do not apply a holding force, apply a holding force perpendicular to the cutting plane (increasing the force required to make the cut), puncture the bread product, or force a fixed blade through the bread product.
- The present invention centers the bread product with respect to a vertical slot that guides the cutting utensil, despite typical variations is shape and size of the roundly shaped bread products, through the use of the angled planes that center the bread product both top and bottom with respect the vertical slot. All known prior art has either one fixed surface and one movable surface or it has a wide chamber, neither of which will assure the cutting plane in the center of the bread product.
- The present invention is useful for bisecting a variety of roundly shaped bread products, from bagels to bulkie rolls to English muffins, without requiring any adjustments to the invention. No prior art has this degree of versatility without adjustment.
- The user can cut all the way through the bread product using the present invention, regardless of typical variations is shape and size of the roundly shaped bread products. The preferred embodiment would include a strip of cut resistant plastic such as UHMW at the bottom of the vertical slot in the base unit to protect the invention from damage during the slicing operation.
- The present invention is inexpensive to produce in large quantities, because most of the components in the preferred embodiment can be injection molded.
- The only movable piece is the top block, and there is no adjustment required for different size and shaped bread products, so it is simple to understand, easy to use, and easy to clean.

This present invention includes but is not limited to the preferred embodiment. Alternate materials such as wood, metal, fabricated plastic, or other similar materials could be used and still fall under the scope of the present invention. Specifics of the design as shown in FIG. 1–6 could be changed and still fall under the scope of the present invention. The angled surfaces that center the bread product top and bottom could be a series of planes (as shown in the base unit), or they could be conical (as shown in the top block) or elliptical or parabolic in design, when viewed in cross-section from the front, as in FIG. 6. If the step on the front and back of the base unit were eliminated, this would still be covered under the scope of the present invention. If the top of the top block was flat rather than convex, it would still be covered under the scope of the present invention. The appended claims and their legal equivalents, rather than the specifics of the preferred embodiment should determine the scope of the present invention.

I claim as my invention:

1. A slicing apparatus for approximately bisecting roundly shaped bread products comprising:

a base unit containing a U shaped chamber, with an opening at the top which is sized to receive a range of said roundly shaped bread products, having a vertical slot bisecting the narrower side walls of said chamber, starting at the top of said chamber and terminating a set distance below the bottom of said chamber, having also a portion of said shorter side walls as well as a portion of the longer side walls of said chamber angle inwards, when measured from said top to said bottom of said chamber, wherein the improvement comprises a means of centering the bottom of bagels as well as a broad array of said roundly shaped bread products with respect to said vertical slot, comprising said walls that extend generally vertically downward from said opening for a set distance and then turn and angle inwards for a set distance and terminate in a horizontal section, when viewed in cross section from both the side and front of said base unit;

a means of restricting the motion of said bread products during the vertical slicing operation, comprising a separate top block which is a somewhat smaller than said opening of said chamber, to be placed on top of the upper edge of one of said roundly shaped bread products which has been placed in said chamber, a means of allowing the free back and forth movement of a common bread knife under said top block comprising a vertical slot on the underside of said top block which is large enough to receive said common bread knife, positioned such that said vertical slot would coincide with said vertical slot in said chamber when said top block is placed on top of one of said bread products which has been placed in said chamber;

a means of centering the top of said bread products with respect to said vertical slot in said top block, comprising walls that, when viewed in cross section from the side, extend at an angle upward from the bottom front and back edges of said top block for a set distance and terminate in a horizontal section, whereby a broad array of said roundly shaped bread products, ranging from large and irregularly shaped bagels, kaiser rolls, and portuguese sweet rolls to typical english muffins, may be sliced into two approximately equal sections, without causing damage and deformation to said bread products.

2. The apparatus of claim 1 wherein said side walls of said chamber extend generally vertically downward from said opening for a distance that is slightly greater than half of the diameter of said larger than average bagel, at which point said side walls turn and angle inwards at an approximately forty five degree angle for a set distance and terminate in a horizontal section, when viewed in cross section from said front of said base unit.

3. The apparatus of claim 2 wherein said horizontal section is dimensioned such that said side walls which turn and angle inwards at an approximately forty five degree angle for a set distance and terminate in said horizontal section, as well as said horizontal section, would be approximately tangent to a circle which is approximately equal to the diameter of said typical english muffin, which is the smallest of said range of said roundly shaped bread products.

4. The apparatus of claim 1 wherein said opening at the top of said chamber is approximately rectangular, with an approximately forty five degree chamfer at each of the four corners of said opening.

5. The apparatus of claim 4 further including chamber walls that extend generally vertically downward from said chamfers which follow the intersection of said side, front and back walls, then turn and angle inwards in parallel with said side walls, and turn and form a section that is parallel to said horizontal section, forming said sections that angle inward from said front and said back walls to said horizontal section.

6. The apparatus of claim 5 wherein said chamfers reduce the width of said side walls of said chamber in the section of said side walls that extend generally vertically downward, as well as on said angled portion of said side walls, as well as on said horizontal section, to somewhat less than the width of an english muffin, which is the smallest of said range of said roundly shaped bread products.

7. The apparatus of claim 5 wherein said sections that angle inward from said front and said back walls to said horizontal section are at an angle which is approximately sixty degrees from horizontal in order to more effectively center a broader range of said bread products than if said surfaces were angled at approximately forty five degrees or less.

8. The apparatus of claim 1 wherein said vertical slot in said chamber extends below said chamber whereby said common bread knife can easily pass completely through said bread product.

9. The apparatus of claim 1 further including a cut resistant strip which, when properly dimensioned, can be press fitted into a recess in said bottom of said vertical slot in said base unit using only mechanical force to retain said cut resistant strip in said vertical slot; said cut resistant strip being approximately ⅛inch wide, ⅛inch to ¼inch high and approximately as long as said base unit is wide, for the purpose of minimizing damage to said base unit as a result of said slicing operation.

10. The apparatus of claim 1 wherein the largest portion of said base unit is a single injection molded component which includes a step on the front and back of said base unit that widens the narrower dimension of said base unit, wherein increased stability and safety during said slicing operation are provided.

11. The apparatus of claim 1 wherein said top block having as part of the design a means of centering said top of said bread products with respect to said vertical slot in said top block, comprising walls that, when viewed in cross section from the side, extend at an angle of approximately sixty degrees from horizontal, upward from said bottom front and back edges of said top block for a set distance and terminate in a horizontal section.

12. The apparatus of claim 11 wherein said angled walls in said top block extend upward at an angle of approximately sixty degrees from horizontal, starting at said bottom front and back edges of said top block, thereby reducing the width of said horizontal section to somewhat less than the width of an english muffin, which is the smallest of said range of said roundly shaped bread products, whereby sections that angle inward from said bottom front and back edges to said horizontal section are at an angle which is approximately sixty degrees from horizontal in order to more effectively center a broader range of said bread products than if said surfaces were angled at approximately forty five degrees or less, whereby said bread products as small as said typical english muffins would be centered with respect to said vertical slot when said top block is places on top of said bread product.

13. The apparatus of claim 11 wherein said vertical slot on said underside of said top block bisects said top block, which is the correct size and shape to allow said common bread knife to be placed edge downward into said vertical slot, so that said common bread knife would have little to no contact with said bread product when first placed together on top of said bread product in said chamber of said base unit.

14. The apparatus of claim 11 wherein there is a means of distributing the downward force applied through the top of said top block to the upper edge of said roundly shaped bread product during the slicing operation, comprising a design wherein said angled walls extending upward from said bottom edges of said front and back of said top block, when viewed in cross section from either said front and said back, form a conical surface wherein the largest diameter of said conical surface is somewhat larger that the diameter of the largest of a range of said roundly shaped bread products.

* * * * *